US010393482B2

(12) United States Patent
Khatiwada et al.

(10) Patent No.: US 10,393,482 B2
(45) Date of Patent: Aug. 27, 2019

(54) SYSTEM AND METHOD FOR ALTERING A BURN RATE OF A PROPELLANT

(71) Applicants: Suman Khatiwada, Houston, TX (US); John Welch, Spring, TX (US); Anil Sadana, Houston, TX (US); Ramon Garza, Pearland, TX (US)

(72) Inventors: Suman Khatiwada, Houston, TX (US); John Welch, Spring, TX (US); Anil Sadana, Houston, TX (US); Ramon Garza, Pearland, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 168 days.

(21) Appl. No.: 15/340,429

(22) Filed: Nov. 1, 2016

(65) Prior Publication Data

US 2018/0120066 A1 May 3, 2018

(51) Int. Cl.

| | |
|---|---|
| ***C06B 45/12*** | (2006.01) |
| ***F42B 3/04*** | (2006.01) |
| ***F42B 3/22*** | (2006.01) |
| ***E21B 23/06*** | (2006.01) |
| *C06B 45/00* | (2006.01) |
| *C06B 31/00* | (2006.01) |
| *D03D 23/00* | (2006.01) |
| *D03D 43/00* | (2006.01) |

(52) U.S. Cl.
CPC ..... *F42B 3/04* (2013.01); *E21B 23/065* (2013.01); *F42B 3/22* (2013.01)

(58) Field of Classification Search
USPC ..... 149/2, 14, 45, 108.4, 109.4
See application file for complete search history.

(56) References Cited

U.S. PATENT DOCUMENTS

| | | | | |
|---|---|---|---|---|
| 5,396,951 A * | 3/1995 | Ross | E21B 23/065 166/63 |
| 2016/0053561 A1* | 2/2016 | Carr | F42B 3/04 102/200 |
| 2016/0258242 A1* | 9/2016 | Hayter | G05B 19/4099 |

* cited by examiner

*Primary Examiner* — James E McDonough
(74) *Attorney, Agent, or Firm* — Cantor Colburn LLP

(57) ABSTRACT

A system and apparatus for providing an apparatus for use in a wellbore. The apparatus includes an apparatus body defining a volume, a propellant disposed within the volume, wherein the propellant has a first burn rate, and at least one propellant insert disposed within the propellant, wherein the propellant insert has a second burn rate, and the second burn rate is different than the first burn rate.

10 Claims, 2 Drawing Sheets

SYSTEM AND METHOD FOR ALTERING A BURN RATE OF A PROPELLANT

BACKGROUND

1. Field of the Disclosure

The present invention is related to a system, apparatus and method of altering a burn rate of a fuel source in a wellbore, and in particular, a system and apparatus of altering a burn rate of a fuel source for equipment used in a wellbore.

2. Background of the Art

Various downhole operations, such as production, fracturing operations, etc., require downhole fuel sources. In such applications, packers and other setting tools, may be actuated and expanded by combustion of fuel sources. Certain applications may require different burn rates to allow for optimal operation. However, downhole fuel sources that burn at selected rates may have complex formulations and other manufacturing challenges.

SUMMARY OF THE DISCLOSURE

In one aspect, the present disclosure provides an apparatus for use in a wellbore, including an apparatus body defining a volume, a propellant disposed within the volume, wherein the propellant has a first burn rate, and at least one propellant insert disposed within the propellant, wherein the propellant insert has a second burn rate, and the second burn rate is different than the first burn rate.

In another aspect, the present disclosure provides a system for use in a wellbore, including a tool, and a fuel source associated with the tool, the fuel source including a fuel source body defining a volume, a propellant disposed within the volume, wherein the propellant has a first burn rate, and at least one propellant insert disposed within the propellant, wherein the propellant insert has a second burn rate, and the second burn rate is different than the first burn rate.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures in which like numerals have generally been assigned to like elements and in which.

DESCRIPTION OF THE EMBODIMENTS

Figure 1:
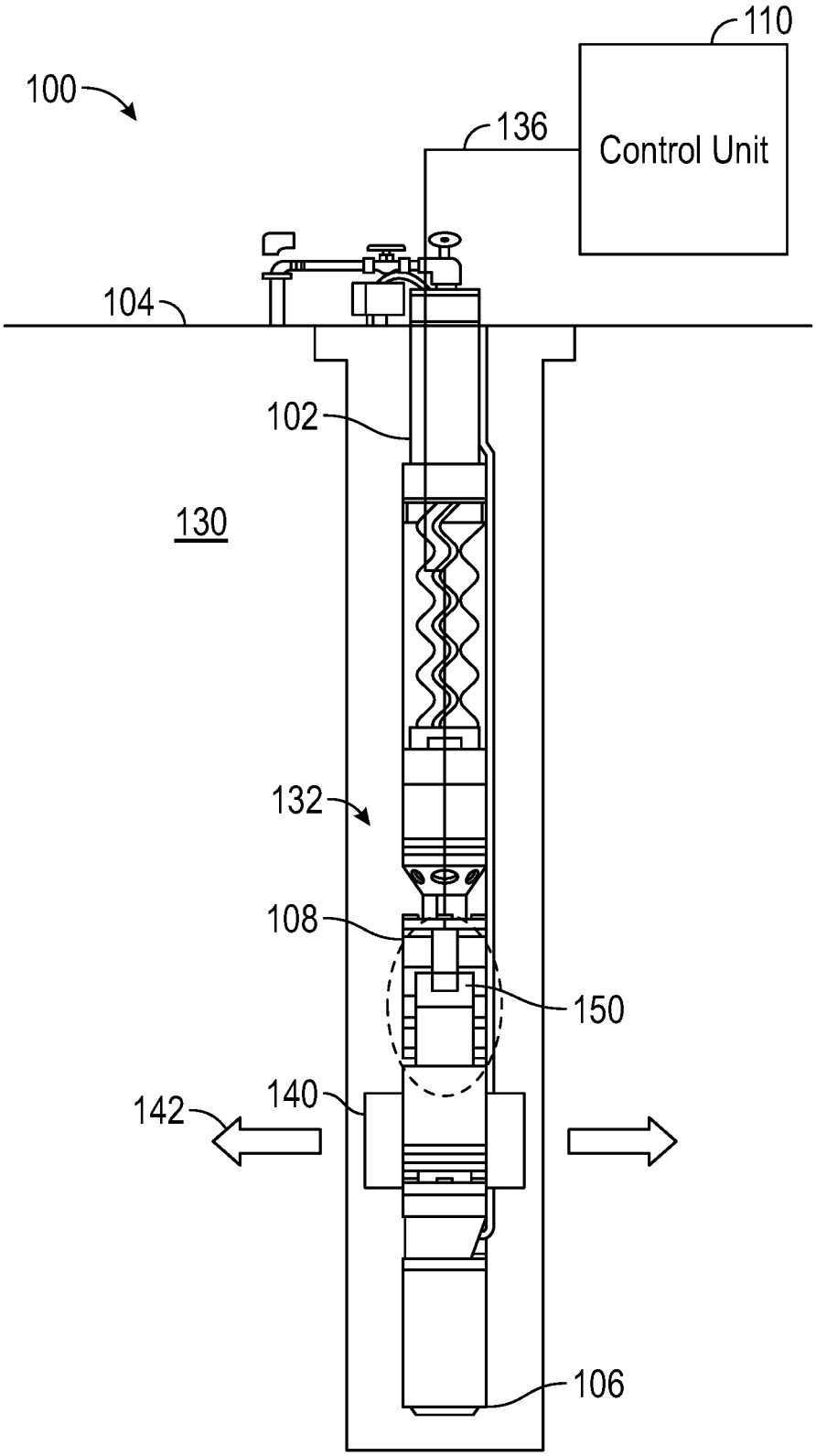
FIG. 1 shows a downhole system that includes a tool utilizing a fuel source in an exemplary embodiment of the disclosure.

FIG. 1 shows a downhole system 100 that includes an expanding tool for setting, packing, or other operations of the downhole system 100 in an exemplary embodiment of the disclosure. The downhole system 100 includes a work string 102 disposed in a wellbore 132 formed in a formation 130. The work string 102 extends in the wellbore 132 from a surface location 104 to a downhole location 106. The work string 102 may include a drill string, a production string, a fracturing system including a multi-stage fracturing system, a perforation string, etc. A tool 108 for performing a downhole operation is conveyed to a selected depth of the wellbore by the work string 102. The tool 108 may be a setting tool, a packing tool, a knife or other tool that relies on a downhole fuel source for expansion or general operation, for example. The tool 108 may be coupled to a control unit 110 via cable 136. Control unit 110 controls the tool 108 to actuate the tool via igniting the fuel source, controlling combustion of a fuel source within the tool, and other functions of the tool. In various embodiments, the control unit 110 may be at a surface location 104 or at a suitable location in the work string 102. The control unit 110 may perform the methods disclosed herein for controlling operation of the tool 108 using the fuel source 150.

The tool 108 is schematically illustrated in FIG. 1. As previously discussed, the tool 108 may be any tool that expands, sets, separates, or is otherwise actuated by the expansion of combustible gases, such as those provided by the ignition of the fuel source 150. In an exemplary embodiment, the tool 108 is a tool wherein expanding elements 140 move outwardly in an expansion direction 142 when energized by high pressure gasses created by fuel source 150. Tool 108 may be used to prevent flow beyond the position of tool 108, secure another element of string 102 at a certain position at the wellbore 132, chemically cut an element of string 102, etc. In an exemplary embodiment, the fuel source 150 may be ignited to create high temperature and high pressure combustion gasses. In response to these gases, expanding elements 140 of tool 108 may move outwardly in an expansion direction 142 to secure expanding elements 140 towards the outer extents of wellbore 132. In certain embodiments, expanding elements 140 may be compliant elements, while in other embodiments, expanding elements 140 may be rigid elements. Further, expanding elements 140 may be slips or other elements that may expand to create contact with wellbore 132.

Fuel source 150 may be used to actuate tool 108. In exemplary embodiments, fuel source 150 may be a multi-stage charge or a single stage charge. Details of the fuel source are discussed below with respect to FIGS. 2-4.

Figure 2:
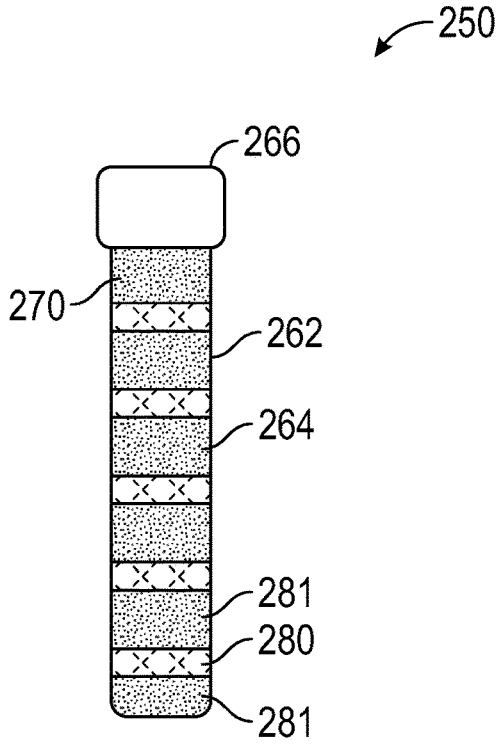
FIG. 2 shows an exemplary fuel source of the downhole system of FIG. 1 suitable for use in downhole operations in an exemplary embodiment of the present disclosure.

FIG. 2 shows an exemplary fuel source 250 suitable for use in downhole operations in an exemplary embodiment of the present disclosure. Fuel source 250 may be used in any mechanical, flammable, or explosive downhole device. In the illustrated embodiment, the fuel source 250 includes a fuel source body 262, a volume 264, a propellant 270, and at least one propellant insert 280. In the illustrated embodiment, the propellant inserts 280 of the fuel source 250 can alter the burn rate of the propellant 270 to accelerate or decelerate the effective burn rate of the propellant 270.

In the illustrated embodiment, the fuel source 250 is contained within the body 262. In the illustrated embodiment, the body 262 defines a volume 264 that contains the propellant 270. The body 262 can be formed from a polymeric material, cellulosic material or any other suitable material. In certain embodiments, the body 262 is formed from a cardboard material. In the illustrated embodiment, the body 262 can include a cap 266 to enclose the volume 264.

In the illustrated embodiment, the propellant 270 is contained within the volume 264. The propellant 270 is an energetic material that can release energy and gasses upon activation. The propellant 270 can be a slurry or dough that is disposed within the volume 264. In the illustrated embodiment, the propellant 270 can include a mixture including, but not limited to a mixture of the following chemical components: gilsonite resin, strontium nitrate, diatomaceous earth, toluene, hydroxyl-terminated polybutadiene, polyurethane resins, potassium nitrate, and polyesters such as dioctyl adipate.

In the illustrated embodiment, the propellant 270 has an inherent burn rate based on the chemical properties of the propellant 270 selected. In certain applications, it is desired to alter the inherent burn rate of the propellant 270 to allow for a faster burn rate or a slower burn rate. A faster burn rate can allow for a peak pressure to be applied to the tool 108 for a shorter time period, while a slower burn rate can allow for a peak pressure to be applied to a tool 108 for a longer time period.

In the illustrated embodiment, propellant inserts 280 are disposed within the volume 264 to alter the inherent burn rate of the propellant 270. The propellant inserts 280 can alter the burn rate of the propellant 270 by creating divided volumes 281 and further burning at a different rate from the propellant 270 to create an effective altered burn rate of the fuel source 250.

In certain embodiments, propellant inserts 280 are disposed within the volume 264 to create divided volumes 281. In the illustrated embodiment, propellant 270 is disposed within the divided volumes 281. By locating the propellant 270 in divided volumes 281, portions of the propellant 270 are burned in discrete time intervals. This can allow for a desired pressure output over a desired time interval. By disposing the propellant 270 within the divided volumes 281, the natural burn rate of the propellant 270 is altered to be accelerated or decelerated depending on the desired burn rate.

In certain embodiments, the chemical composition and inherent burn rate of the propellant inserts 280 can be utilized to slow the effective burn rate of the fuel source 250. In the illustrated embodiment, slow burning propellant inserts 280 can be formed from cannon fuse material, including, but not limited to slow match, punks, black match, quick match, visco fuse, safety fuse, paper, rope, etc. In certain embodiments, the propellant insert 280 is formed from waxed or lacquered paper containing fine black powder. In other embodiments, the propellant inserts 280 can be formed from oxamide, melamine, azodicarbonamide and derivatives thereof.

In certain embodiments, these propellant inserts 280 have a burn rate that is slower than the propellant 270. Therefore, in certain embodiments, as the propellant 270 in a single divided volume 281 is burned, the propellant insert 280 is then burned to expose the propellant 270 in the next divided volume 281. In the illustrated embodiment, by selectively exposing the propellant 270 via the propellant inserts 280, stepwise or otherwise more controlled pressure output is achieved by ignition of the fuel source 250. In certain embodiments, the fuel source 250 can provide a desired pressure characteristic over 4 minutes.

In certain embodiments, propellant inserts 280 that slow the burn rate of the propellant 270 can be utilized in tools such as composite plugs or elastomeric packers to provide a controlled pressure build up to allow for proper setting without causing damage to the tool. Advantageously, by slowing the burn rate of the propellant 270 via propellant inserts 280, propellants 270 do not need to be chemically altered or substituted to provide a desired pressure release characteristic. In certain embodiments, slow burning propellants are often complex and difficult to manufacture, store and transport. Advantageously, by using propellant inserts 280 more readily available propellants 270 can be utilized with a desired burn rate.

In certain embodiments, the chemical composition and inherent burn rate of the propellant inserts 280 can be utilized to accelerate the effective burn rate of the fuel source 250. In certain embodiments fast burning propellant inserts 280 can be formed from 5-aminotetrazole, potassium perchlorate, sulphur, carbon, or any other suitable fuse material. These fast burning propellant inserts 280 can decompose into hot gasses, including oxygen that accelerate the burn rate of the propellant 270 accelerating the burn rate of the fuel source 250. In certain embodiments, the fuel source can provide a desired pressure characteristic in less than 10 seconds. Advantageously, by utilizing the propellant inserts 280 described herein materials which require special handling, transportation, storage and export control requirements can be avoided.

Figure 3:
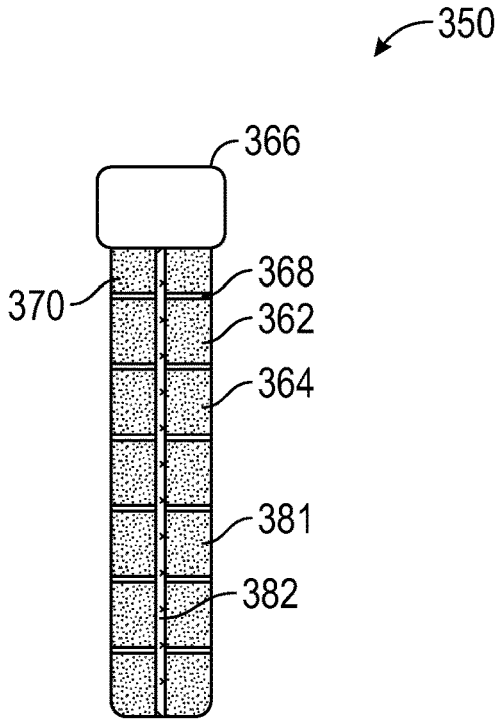
FIG. 3 shows another embodiment of a fuel source of the downhole system suitable for use in downhole operations in another embodiment of the present disclosure.

Referring to FIG. 3, another embodiment of the fuel source 350 suitable for use in downhole operations in an exemplary embodiment of the present disclosure is shown. In the illustrated embodiment, the fuel source 350 includes barriers 368 and a vertically disposed propellant insert 382.

In the illustrated embodiment, the barriers 368 are formed from a same or similar material as the remainder of the body 362. In certain embodiments, the barriers 368 are polymeric discs to divide the volume 364 as previously described. In the illustrated embodiment, the divided volumes 381 can alter the burn rate of the propellant 370 as previously described.

In the illustrated embodiment, the vertically disposed propellant insert 382 is disposed within the propellant 370. In the illustrated embodiment, the vertically disposed propellant insert 382 can ignite the propellant 370 within each divided volume 381 and propagate ignition to each divided volume 381. In the illustrated embodiment, the vertically disposed propellant insert 382 can be utilized to ensure that ignition is achieved in all divided volumes 281. In the illustrated embodiment, by selectively exposing the propellant 370 by the controlled ignition of the vertically disposed propellant insert 382, stepwise or otherwise more controlled pressure output is achieved by ignition of the fuel source 350.

Figure 4:
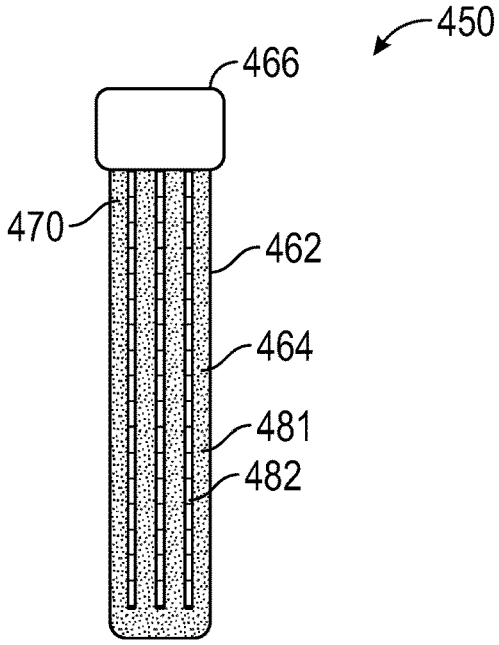
FIG. 4 shows another embodiment of a fuel source of the downhole system suitable for use in downhole operations in another embodiment of the present disclosure.

Referring to FIG. 4, another embodiment of the fuel source 450 suitable for use in downhole operations in an exemplary embodiment of the present disclosure. In the illustrated embodiment, the fuel source 450 includes at least one vertically disposed propellant insert 482.

In the illustrated embodiment, the vertically disposed propellant insert 482 is disposed within the propellant 470. In certain embodiments, the vertically disposed propellant insert 482 can be at least one wire, screen or foil. In certain embodiments, the vertically disposed propellant insert 482 is formed from a conducting metal, including, but not limited to copper. In the illustrated embodiment, the vertically disposed propellant insert 482 can ignite the propellant 470 and propagate ignition within the volume 464. In the illustrated embodiment, the vertically disposed propellant insert 482 can be utilized to ensure that complete ignition is achieved. In the illustrated embodiment, by exposing the propellant 470 to the ignition of the vertically disposed propellant insert 482 the effective burn rate of the propellant 470 can be accelerated.

Therefore in one aspect, the present disclosure provides an apparatus for use in a wellbore, including an apparatus body defining a volume, a propellant disposed within the volume, wherein the propellant has a first burn rate, and at least one propellant insert disposed within the propellant, wherein the propellant insert has a second burn rate, and the second burn rate is different than the first burn rate. In various embodiments, the apparatus body is polymeric. In various embodiments, the propellant is at least one of potassium perchlorate, gilsonite resin, strontium nitrate, diatomaceous earth, and toluene. In various embodiments, the volume includes a plurality of divided volumes. In various embodiments, the plurality of divided volumes is defined by at least one polymeric barrier within the apparatus body. In various embodiments, the plurality of divided volumes is defined by the at least one propellant insert. In various embodiments, the at least one propellant insert is vertically disposed within the apparatus body. In various embodiments, the second burn rate is slower than the first burn rate. In various embodiments, the propellant insert is at least one of slow match, punks, black match, quick match, visco fuse, safety fuse, paper and rope. In various embodiments, the second burn rate is faster than the first burn rate. In various embodiments, the propellant insert is at least one of 5-aminotetrazole and azodicarbonamide.

In another aspect, the present disclosure provides a system for use in a wellbore, including a tool, and a fuel source associated with the tool, the fuel source including a fuel source body defining a volume, a propellant disposed within the volume, wherein the propellant has a first burn rate, and at least one propellant insert disposed within the propellant, wherein the propellant insert has a second burn rate, and the second burn rate is different than the first burn rate. In various embodiments, the apparatus body is polymeric. In various embodiments, the propellant is at least one of potassium perchlorate, gilsonite resin, strontium nitrate, diatomaceous earth, and toluene. In various embodiments, the volume includes a plurality of divided volumes. In various embodiments, the plurality of divided volumes is defined by at least one polymeric barrier within the apparatus body. In various embodiments, the plurality of divided volumes is defined by the at least one propellant insert. In various embodiments, the at least one propellant insert is vertically disposed within the apparatus body. In various embodiments, the second burn rate is slower than the first burn rate. In various embodiments, the second burn rate is faster than the first burn rate.

While the foregoing disclosure is directed to the certain exemplary embodiments of the disclosure, various modifications will be apparent to those skilled in the art. It is intended that all variations within the scope and spirit of the appended claims be embraced by the foregoing disclosure.

What is claimed is:

1. A system for use in a wellbore, comprising:

a tool; and a fuel source associated with the tool, the fuel source comprising:

a fuel source body defining a volume;

at least one propellant insert disposed within the volume to create a plurality of divided volumes; and a propellant disposed within the divided volumes, the propellant having a first burn rate and the propellant insert having a second burn rate different than the first burn rate, wherein as the propellant in a single divided volume is burned, the propellant insert is then burned to expose the propellant in the next divided volume.

2. The system of claim 1, wherein the fuel source body is polymeric or cellulosic.

3. The system of claim 1, wherein the propellant is at least one of, gilsonite resin, strontium nitrate, diatomaceous earth, hydroxyl-terminated polybutadiene, polyurethane resin, potassium nitrate, polyester and toluene.

4. The system of claim 1, wherein the plurality of divided volumes is defined by at least one polymeric barrier within the fuel source body.

5. The system of claim 1, wherein the at least one propellant insert is vertically disposed within the fuel source body.

6. The system of claim 1, wherein the second burn rate is slower than the first burn rate.

7. The system of claim 1, wherein the second burn rate is faster than the first burn rate.

8. The system of claim 5, wherein the propellant insert is at least one of a wire, a screen, and a foil.

9. The system of claim 1, wherein the propellant insert includes at least one of oxamide, melamine, azodicarbonamide and derivatives thereof.

10. The system of claim 1, wherein selectively exposing the propellant controls a pressure achieved by ignition of the fuel source in a stepwise manner.

* * * * *